US010597968B2

(12) United States Patent
McAdam et al.

(10) Patent No.: US 10,597,968 B2
(45) Date of Patent: Mar. 24, 2020

(54) MODIFIED STUFFING BOX

(71) Applicant: DRECO ENERGY SERVICES ULC, Edmonton (CA)

(72) Inventors: David McAdam, Calgary (CA); Brian McAdam, Calgary (CA)

(73) Assignee: Dreco Energy Services ULC, Calgary (CA)

( * ) Notice: Subject to any disclaimer, the term of this patent is extended or adjusted under 35 U.S.C. 154(b) by 63 days.

(21) Appl. No.: 15/742,632

(22) PCT Filed: Mar. 31, 2016

(86) PCT No.: PCT/CA2016/050373
§ 371 (c)(1),
(2) Date: Jan. 8, 2018

(87) PCT Pub. No.: WO2017/004696
PCT Pub. Date: Jan. 12, 2017

(65) Prior Publication Data

US 2018/0202254 A1 Jul. 19, 2018

Related U.S. Application Data

(60) Provisional application No. 62/190,505, filed on Jul. 9, 2015, provisional application No. 62/190,347, filed on Jul. 9, 2015.

(51) Int. Cl.
*E21B 33/08* (2006.01)
*E21B 34/02* (2006.01)
(Continued)

(52) U.S. Cl.
CPC ..... *E21B 33/08* (2013.01); *E21B 21/106* (2013.01); *E21B 34/02* (2013.01); *E21B 43/126* (2013.01);
(Continued)

(58) Field of Classification Search
CPC ..... E21B 21/106; E21B 34/02; E21B 33/08; F15J 16/184; F15J 15/185; F15J 15/187
See application file for complete search history.

(56) References Cited

U.S. PATENT DOCUMENTS 958,862 A 5/1910 Durham
1,517,540 A 12/1924 Hansen
(Continued)

FOREIGN PATENT DOCUMENTS

CA 2153612 2/1997
CA 2544718 11/2006
(Continued)

OTHER PUBLICATIONS

Search Report and Written Opinion for related PCT application PCT/CA2017/050161 dated Apr. 24, 2017 (7 pages).
(Continued)

*Primary Examiner* — Giovanna C Wright
*Assistant Examiner* — Brandon M Duck
(74) *Attorney, Agent, or Firm* — Schwegman Lundberg & Woessner, P.A.

(57) ABSTRACT

A modified stuffing box for a wellhead is provided. More particularly, a modified stuffing box having improved and adjustable sealing is provided. The modified stuffing box may include a valve for sealing the well.

17 Claims, 15 Drawing Sheets

(51) Int. Cl.
*E21B 21/10* (2006.01)
*E21B 43/12* (2006.01)
*E21B 34/00* (2006.01)

(52) U.S. Cl.
CPC ... *E21B 2034/002* (2013.01); *E21B 2034/005* (2013.01)

(56) References Cited

U.S. PATENT DOCUMENTS

| | | | | |
|---|---|---|---|---|
| 1,891,417 | A | 12/1932 | Heggem | |
| 2,059,798 | A | 11/1936 | Kniss | |
| 2,237,709 | A | 4/1941 | Lowe | |
| 2,258,887 | A | 10/1941 | Fortune | |
| 2,573,832 | A | 11/1951 | Callahan | |
| 3,084,946 | A * | 4/1963 | Sharp | E21B 33/08 277/520 |
| 3,186,722 | A | 6/1965 | Johnston | |
| 3,716,245 | A | 2/1973 | Turolla | |
| 4,407,510 | A | 10/1983 | Cornelius et al. | |
| 4,560,176 | A | 12/1985 | Hoff | |
| 4,580,762 | A * | 4/1986 | Hirtz | F16K 5/202 251/159 |
| 4,583,569 | A | 4/1986 | Ahlstone | |
| 4,613,140 | A | 9/1986 | Knox | |
| 4,889,184 | A * | 12/1989 | Lugtmeier | E21B 33/08 166/84.1 |
| 4,951,743 | A | 8/1990 | Henderson | |
| 5,257,812 | A | 11/1993 | Osorio et al. | |
| 5,400,857 | A | 3/1995 | Whitby et al. | |
| 5,636,688 | A | 6/1997 | Bassinger | |
| 5,711,533 | A | 2/1998 | Angelo et al. | |
| 5,791,411 | A | 8/1998 | Ricalton et al. | |
| 5,865,245 | A | 2/1999 | Trout et al. | |
| 6,176,466 | B1 | 1/2001 | Lam et al. | |
| 8,631,861 | B1 | 5/2014 | Busch | |
| 9,188,122 | B1 * | 11/2015 | Reed | F04B 53/1087 |
| 2009/0056930 | A1 | 3/2009 | Angelle et al. | |
| 2011/0198072 | A1 | 8/2011 | Cote et al. | |
| 2011/0203670 | A1 * | 8/2011 | Braddick | E21B 21/106 137/1 |
| 2012/0305102 | A1 * | 12/2012 | Kukielka | E21B 21/106 137/315.02 |
| 2013/0126157 | A1 | 5/2013 | Farrar | |
| 2013/0126763 | A1 * | 5/2013 | Guo | E21B 33/062 251/1.3 |
| 2013/0147121 | A1 | 6/2013 | Xu | |
| 2013/0180733 | A1 | 7/2013 | Bradshaw et al. | |
| 2013/0341045 | A1 | 12/2013 | Flusche | |
| 2015/0300106 | A1 * | 10/2015 | Martin | E21B 33/068 166/382 |

FOREIGN PATENT DOCUMENTS

| | | |
|---|---|---|
| CA | 2509182 | 12/2006 |
| CA | 2942857 | 10/2015 |
| CA | 2991538 | 1/2017 |
| CN | 2567336 | 8/2003 |
| CN | 202090881 | 12/2011 |
| CN | 202731817 | 2/2013 |
| GB | 2206932 | 2/1989 |
| WO | 2017004696 | 1/2017 |

OTHER PUBLICATIONS

Search Report and Written Opinion for related PCT application PCT/CA2017/050890 dated Oct. 17, 2017 (7 pages).

Search Report and Written Opinion for related PCT application PCT/CA2017/050963 dated Nov. 8, 2017 (8 pages).

International Search Report and Written opinion for related PCT application PCT/CA2016/051532 dated Jan. 23, 2017 (8 pages).

International Search Report and Written Opinion for related PCT Application No. PCT/CA2018/050025 dated Apr. 4, 2018 (8 pages).

International Search Report and Written Opinion for related PCT Application No. PCT/CA2018/000101 dated Oct. 26, 2018 (9 pages).

International Search Report and Written Opinion for PCT Application No. PCT/CA2016/050373 dated May 30, 2016 (7 pages).

International Search Report and Written Opinion prepared by the Canadian Intellectual Property Office dated May 17, 2016, for International Application No. PCT/CA2016/050373.

"International Application Serial No. PCT CA2016 050373, International Preliminary Report on Patentability dated Jan. 18, 2018", 6 pgs.

* cited by examiner

MODIFIED STUFFING BOX

CROSS REFERENCE TO RELATED APPLICATIONS

This application is a national stage application under 35 U.S.C. 371 and claims the benefit of PCT Application No. PCT/CA2016/050373 having an international filing date of 31 Mar. 2016, which designated the United States, which PCT application claimed the benefit of U.S. Provisional Application No. 62/190,347 filed 9 Jul. 2015 and U.S. Provisional Application No. 62/190,505 filed 9 Jul. 2015, the disclosure of each of which are incorporated herein by reference.

TECHNICAL FIELD

A modified stuffing box for a wellhead is provided. More particularly, a modified stuffing box having improved and adjustable sealing is provided.

BACKGROUND

Stuffing boxes are commonly used in the oilfield to create a seal between the wellhead and the well tubulars, such as rod string, passing through the wellhead to drive the downhole pump. Conventional stuffing boxes typically comprise a stationary box portion adapted to receive and create a seal with the moving tubular passing through the box in order to retain fluid pressures and prevent the leakage of wellbore fluids.

Often, the stuffing box is secured around the uppermost rod, referred to as the "polished rod". In order to allow for the polished rod to move through the box without damage, one or more packing rings are positioned within the box and concentrically disposed around the shaft of the rod. Such designs are operational when the rod is properly aligned with the box however, over time, abrasive materials in the wellbore fluid or uneven forces imposed upon the rings due to misalignment of the polished rod can cause the inner periphery of the packing rings to wear down causing leakages. The need to realign the polished rod and to replace worn down packing rings costs oil companies in service time, down-time, and environmental cleanup.

Replacement of packing rings is difficult in known stuffing boxes due to inaccessibility of the rings, and the rings becoming hard or brittle over time, making their removal difficult, dangerous, and time consuming. There is a need for a modified, adjustable stuffing box providing for easy access to packing rings.

Stuffing boxes typically provide a safety valve for closing the wellbore in the catastrophic event of breakage of the polished rod. Known valves typically comprise a movable portion that is hingedly attached to the stuffing box in a manner to allow the uni-directional movable portion to pivot from an "open" position (allowing the flow of wellbore fluids) to a "closed" positions, the closed position effectively sealing the surface off from wellbore fluids.

Given its position within the wellbore, conventional valves are commonly exposed to wellbore fluids that wear on the valve components over time, ultimately damaging the valve and allowing fluids to escape through the seal.

There is a need for a modified stuffing box adapted to prevent the safety seal from being exposed to wellbore fluids. There is a need for the modified stuffing box to provide a simple safety valve, minimizing the number of mechanical components required to seal the wellhead.

SUMMARY OF THE INVENTION

In accordance with a broad aspect of the present invention, there is provided a stuffing box for sealing around a rod for wellbore operations, comprising: a tubular body forming a central bore for receiving the rod, the body having a top, a middle and a bottom housings, the middle housing being positionable between and sealingly engageable with the top and bottom housings, the top housing adapted to contain at least one first seal within the bore for sealingly engaging with the rod, the bottom housing adapted to contain at least one second seal within the bore for sealingly engaging with the rod, and an adjuster for releasably connecting the top housing and the bottom housing, and for adjusting misalignment of the rod within the bore, wherein activation of the adjusters compresses the at least one first and second seals to sealingly engage the rod, and secures the middle housing between the top and bottom housings, and deactivation of the adjusters simultaneously decompresses the at least one first and second seals to disengage the sealing engagement with the rod.

In accordance with another aspect of the present invention, the top housing further comprises a valve adapted to pivot between a first position permitting passage of the rod through the bore of the body and a second position sealing the bore of the top housing.

In accordance with yet another aspect of the present invention, the middle housing is configured to house a ball valve operable between a first open position permitting passage of the rod through the bore of the body and a second closed position plugging the borehole and sealing the bore of the top housing.

DESCRIPTION OF THE DRAWINGS

FIGS. 1A and 1B are collectively referred to herein as "FIG. 1";

FIGS. 2A, 2B, and 2C are collectively referred to herein as "FIG. 2";

FIGS. 5A and 5B are collectively referred to herein as "FIG. 5";

FIGS. 6A, 6B, and 6C are collectively referred to herein as "FIG. 6";

FIGS. 7A and 7B are collectively referred to herein as "FIG. 7"

DESCRIPTION OF EMBODIMENTS

According to embodiments herein, a stuffing box is provided for use in a variety of oilfield applications. For example, the stuffing box may be mounted on a wellhead aboveground for sealing with reciprocating wellbore rods driving an underground pump in the well, and particularly the uppermost "polished" rod. Although the present stuffing box is described in connection with reciprocating rods passing through and moving relative to the stuffing box, an alternative embodiment of the present stuffing box may be configured to receive a rotating rod. The present stuffing box may either be pressurized or non-pressurized. The present stuffing box will now be described having regard to FIGS. 1-8.

Figure 1A:
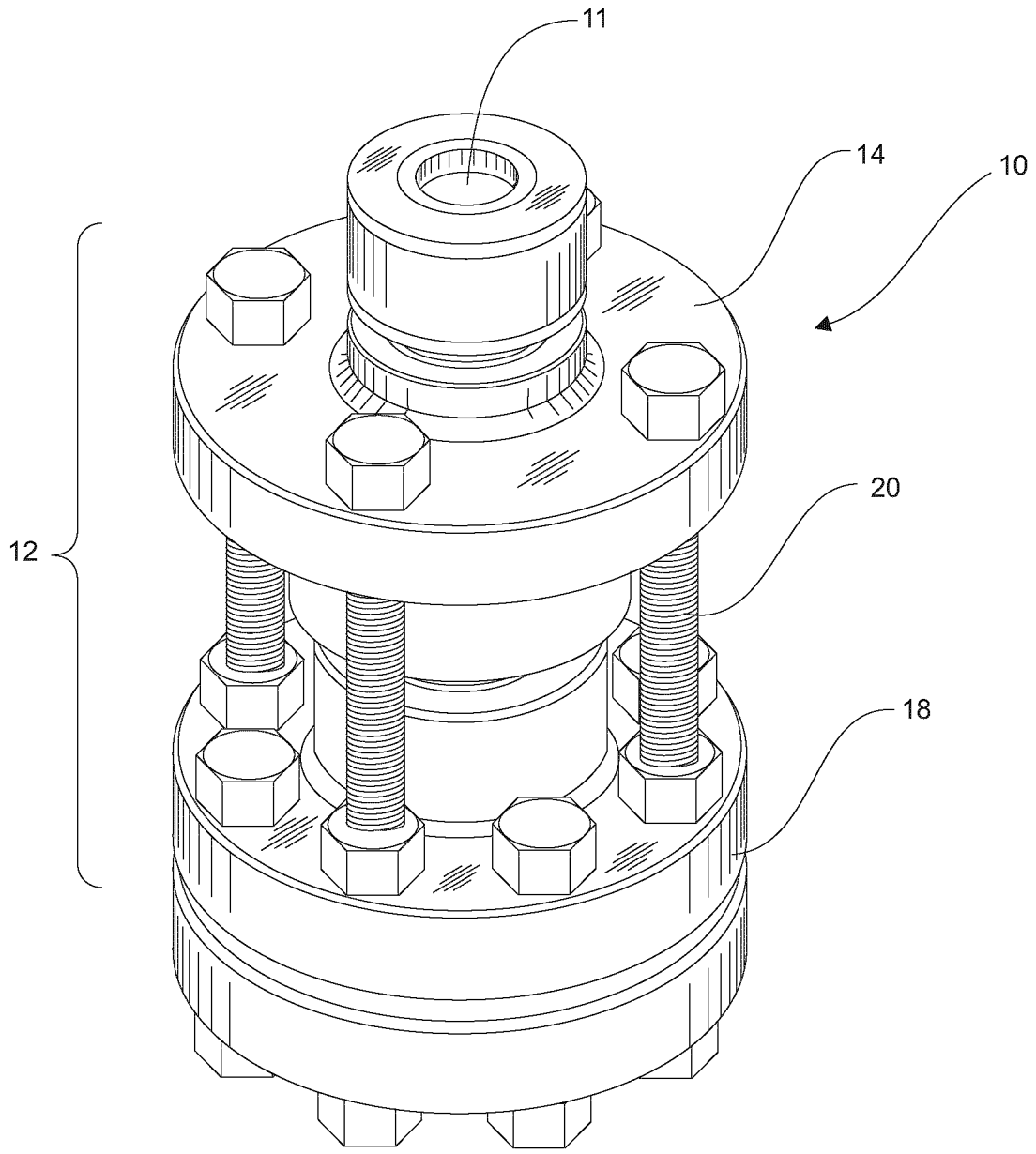
FIG. 1A is a perspective external view of a stuffing box according to embodiments herein.
Figure 1B:
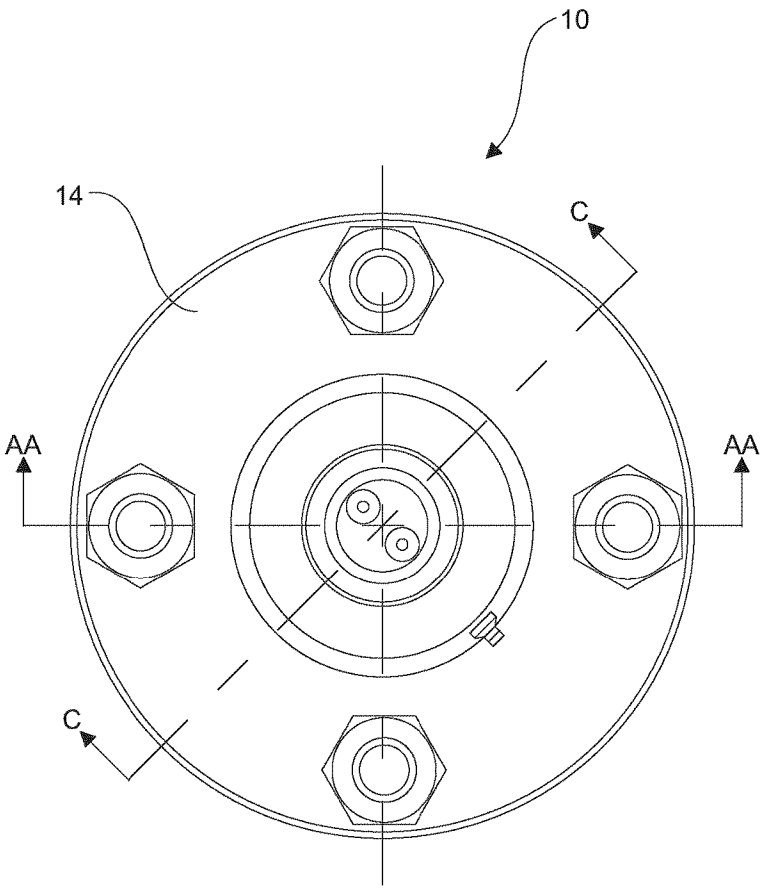
FIG. 1B is a top view of a stuffing box according to embodiments herein.

Having regard to FIG. 1, a perspective external side view and a top view of one embodiment of a stuffing box 10 are provided for sealingly engaging a wellbore rod (not shown) passing through, and moving relative to, the box 10. The stuffing box 10 may comprise a body 12 defining a cylindrical passage or bore 11 along a central axis for receiving the rod.

Body 12 may be adapted to be attached to directly or indirectly to a wellhead (not shown). It should be understood that body 12 may be removably attached to the wellhead via any means known in the art such as threaded engagement, a plurality of radially spaced nut/bolt assemblies (e.g. see FIG. 1), etc.

Having regard to FIGS. 2 and 3, the tubular body 12 may comprise coaxially aligned top 14, middle 16 and bottom 18 housing sections, each section being described in more detail below. It should be understood that reference to terms such as "top", "bottom", "up", or "down" etc., are relative terms for explanatory purposes only.

Top and bottom housings 14, 18 may be releasably connected via an adjuster 20 external to body 12. Adjuster 20 may comprise a plurality of radially spaced connector assemblies 20*a* received in corresponding apertures 21 of both top and bottom housings 14,18. In operation, adjuster 20 may be activated (e.g. tightened) to simultaneously compress top, middle and bottom housings 14,16,18, sealingly engaging the box 10 with the rod "R" (e.g. via at least two seals housed within the box 10 and described in detail below). Conversely, adjuster 20 may be deactivated (e.g. loosened) to simultaneously decompress top, middle and bottom housings 14,16,18, releasing the sealing engagement between the box 10 and the rod "R".

In one embodiment, adjuster 20 may comprise a plurality of nut and bolt connector assemblies 20*a*, and preferably four radially spaced nut/bolt connector assemblies 20*a*. Accordingly, where misalignment of the rod with the bore 11 of the box 10 occurs, each adjuster 20 may be configured to be independently tightened or loosened (depending upon the desire of the operator), serving to adjust the engagement of the box 10 and account for misalignment of the rod.

Figure 3:
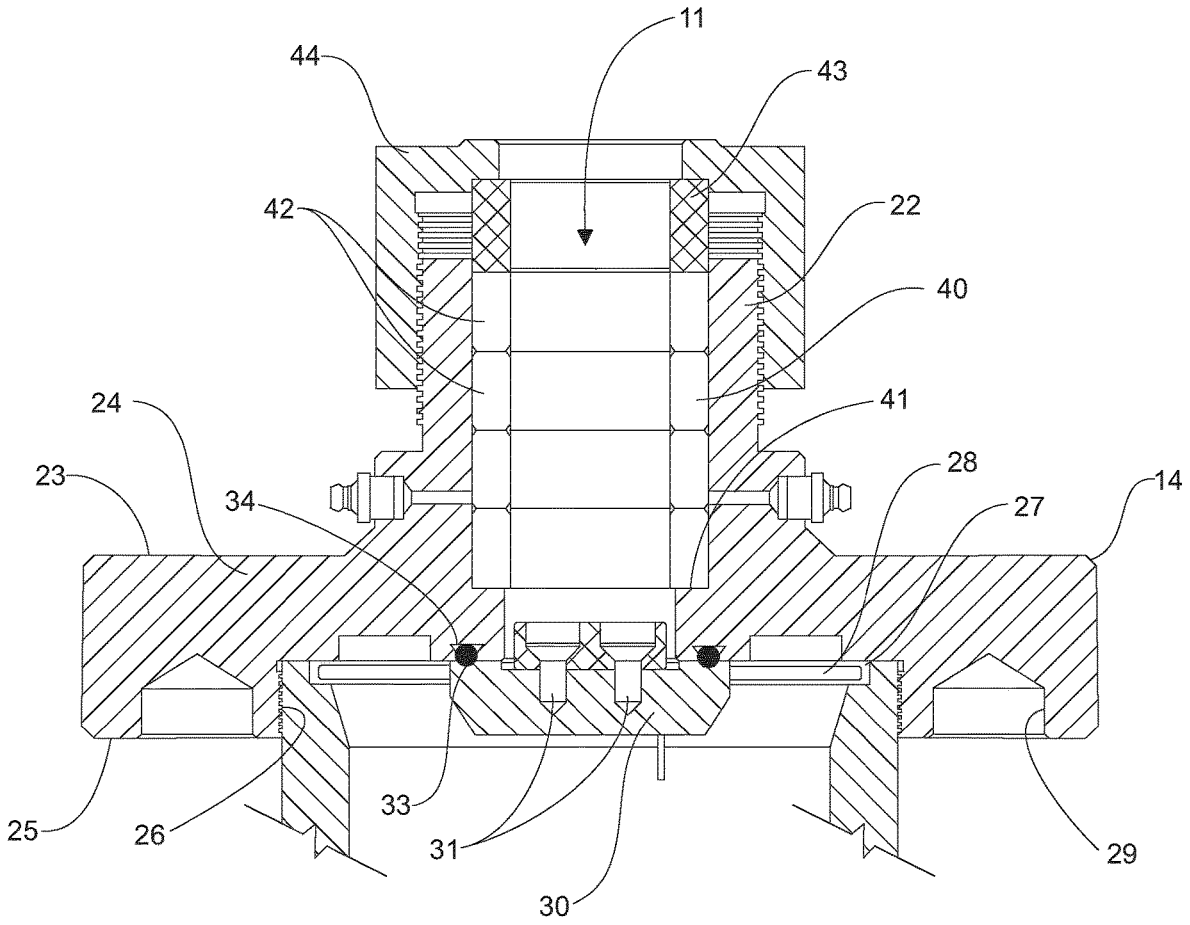
FIG. 3 is a detailed cross section view of the top housing of a stuffing box according to embodiments herein.

Having regard to FIG. 3, top housing 14 may be configured to form an upper neck 22 and a lower flange 24 portion. For example, flange 24 may be integral to and protrude radially outwardly from the cylindrical neck 22. Flange may have top and bottom surfaces 23,25, respectively.

According to embodiments herein, the bottom surface 25 of top housing flange 24 may be adapted to be releasably coupled to middle housing 16 in sealing engagement. For example, bottom surface 25 may comprise a first inner annular groove 26 forming a central downwardly depending cylindrical recess for receiving the top housing 14 in coaxial alignment with the middle housing 16. In one embodiment, top housing 14 may be slidably connected to the middle housing 16. In another embodiment, top housing 14 may be threadably connected to the middle housing 16.

The bottom surface 25 may further provide a second inner annular groove 27 or seat for receiving a first annular seal 28 (e.g. Variseal, TSS Part # DVA30M353-T07HM), preventing fluid leakage between the top housing 14 and the middle housing 16. It is an advantage of the present stuffing box 10 to provide easy removal (e.g. unthreading and/or lifting) of the top housing 14 from the middle housing 16, enabling a worker to access to the internal components of both top housing 14 and middle housing 16 and simple realignment thereof upon replacement of the top housing 14.

As above, top housing 14 may form a plurality of radially spaced apertures 21 for receiving connector assemblies 20*a*. Apertures 21 may entirely traverse the flange 24 (i.e. extending from top surface 23 through to bottom surface 25). Apertures 21 may be sized and shaped to correspond to connector assemblies 20*a*, and preferably may be circular in diameter and sized to receive, for example, a standard connector (e.g. threaded bolt).

Figure 4:
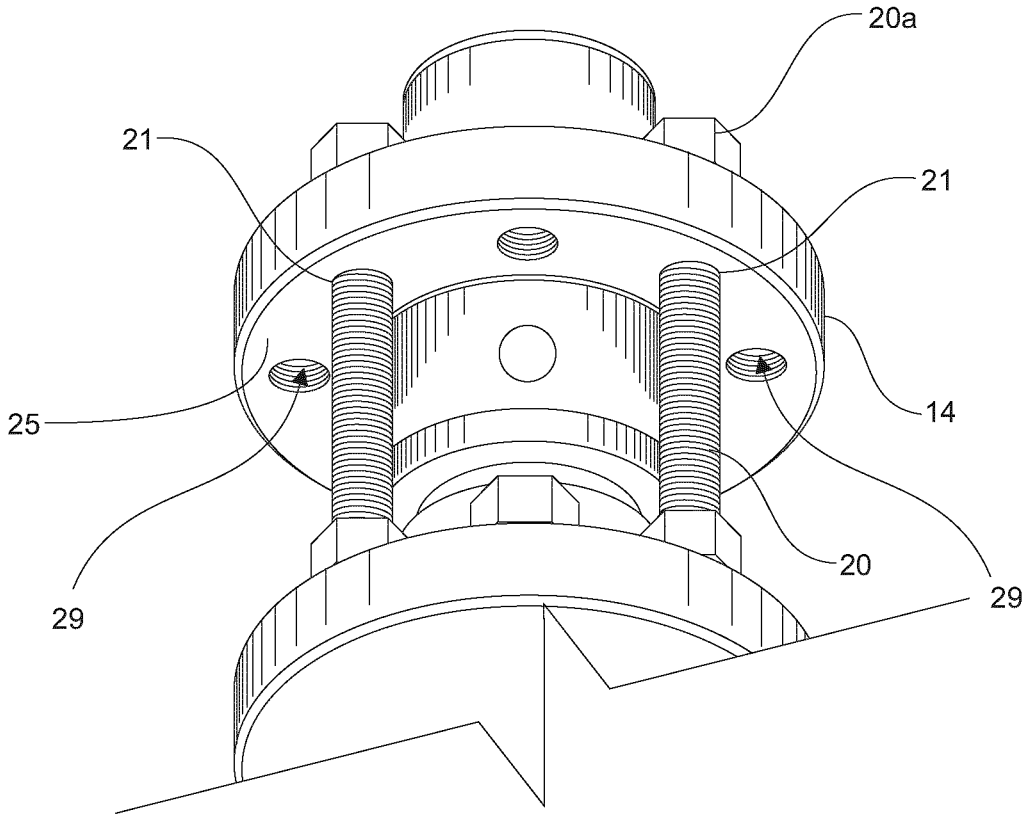
FIG. 4 is a perspective bottom view of a stuffing box according to embodiments herein.

Having regard to FIGS. 3 and 4, the bottom surface 25 of the top housing 14 may further comprise a plurality of radially spaced nesting recesses 29. Recesses 29 may be sized and shaped to correspond to the connector assemblies 20*a*, such that the top housing 14 may be mounted on and supported by the connector assemblies 20*a* (e.g. threaded bolts). As such, in operation, connector assemblies 20*a* (e.g. nuts/bolts) may be loosened off until top housing 14 can be raised upwardly and away from the middle housing 16 and lower flange 18 sections of the box 10 that remain in place, exposing the internal components of the body 12.

Conventionally, in order to maintain or repair the internal components of a stuffing box mounted on a wellhead, the cap of the box must be raised above the worker's head and then clamped to the polished rod, potentially causing damage to the rod and subjecting the worker to significant danger of the cap falling. According to embodiments herein, it is an advantage of the present box 10 that the top housing 14 does not need to be clamped to the rod. Instead, the top housing 14 may be lifted and rotated around the rod until the recesses 29 coaxially align with the corresponding connector assemblies 20*a* (e.g. bolts), and then lowered until the recesses 29 of the top housing 14 slidably receive the connectors 20*a* (e.g. top housing 14 is supported by and resting upon the bolts). As such, the present box 10 enables the worker to safely and easily visualize and access the internal components of the box 10.

Figure 2A:
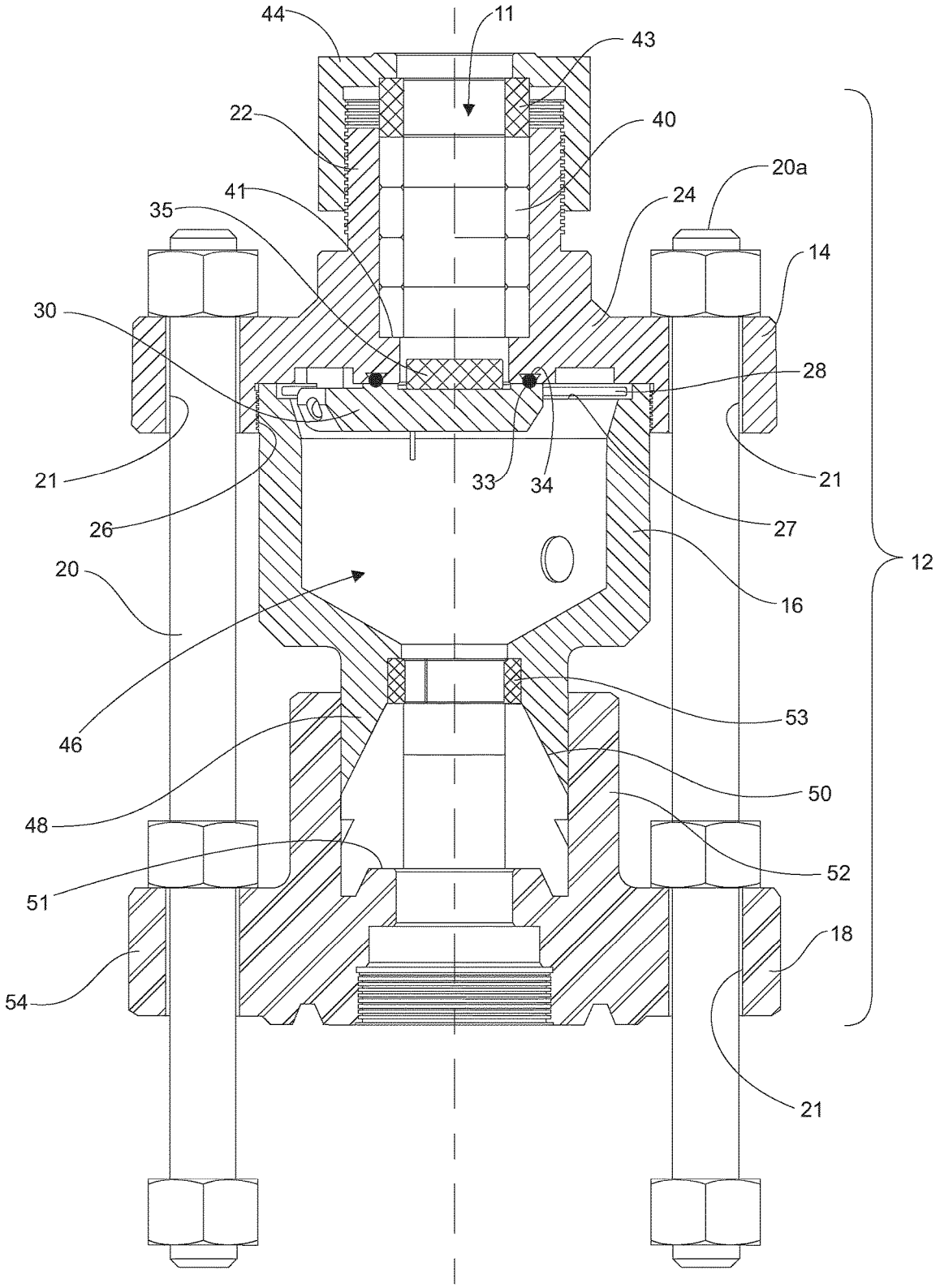
FIG. 2A is a cross section side view along line A-A of the stuffing box shown in FIG. 1B.
Figure 2B:
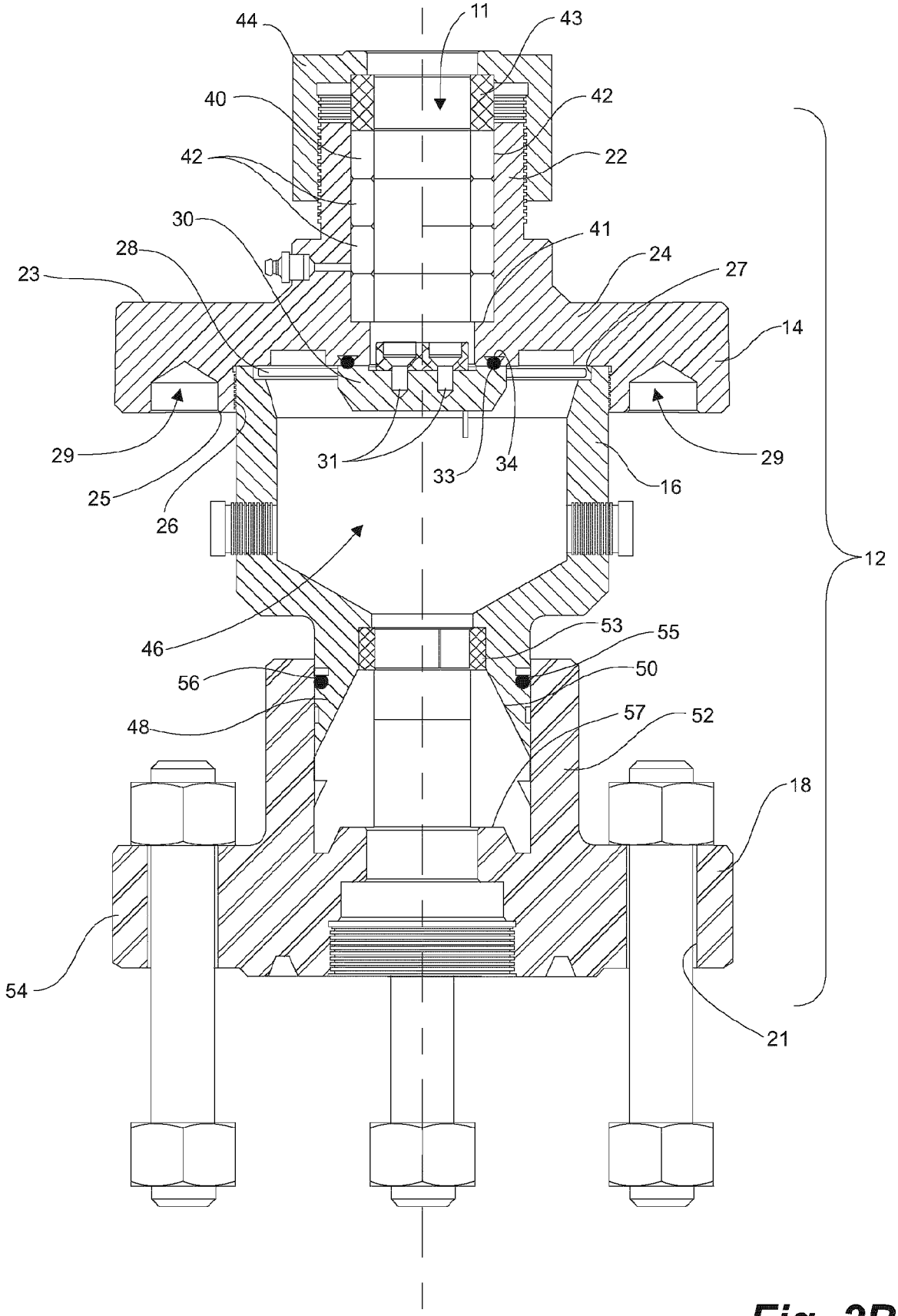
FIG. 2B is a cross section side view along line C-C of the stuffing box shown in FIG. 1B.
Figure 2C:
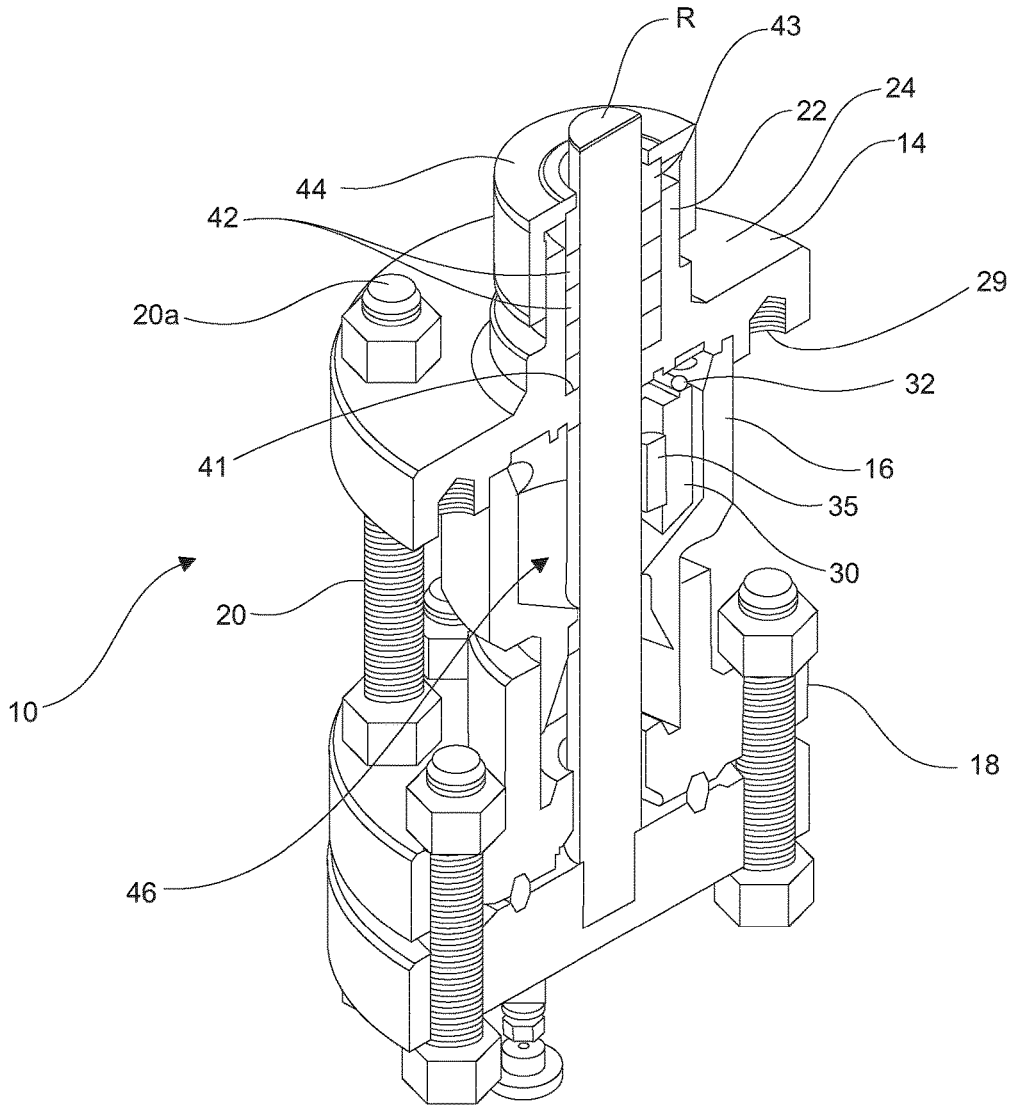
FIG. 2C is a cross section perspective side view of a stuffing box, shown with a rod extending therein, according to embodiments herein.
Figure 5A:
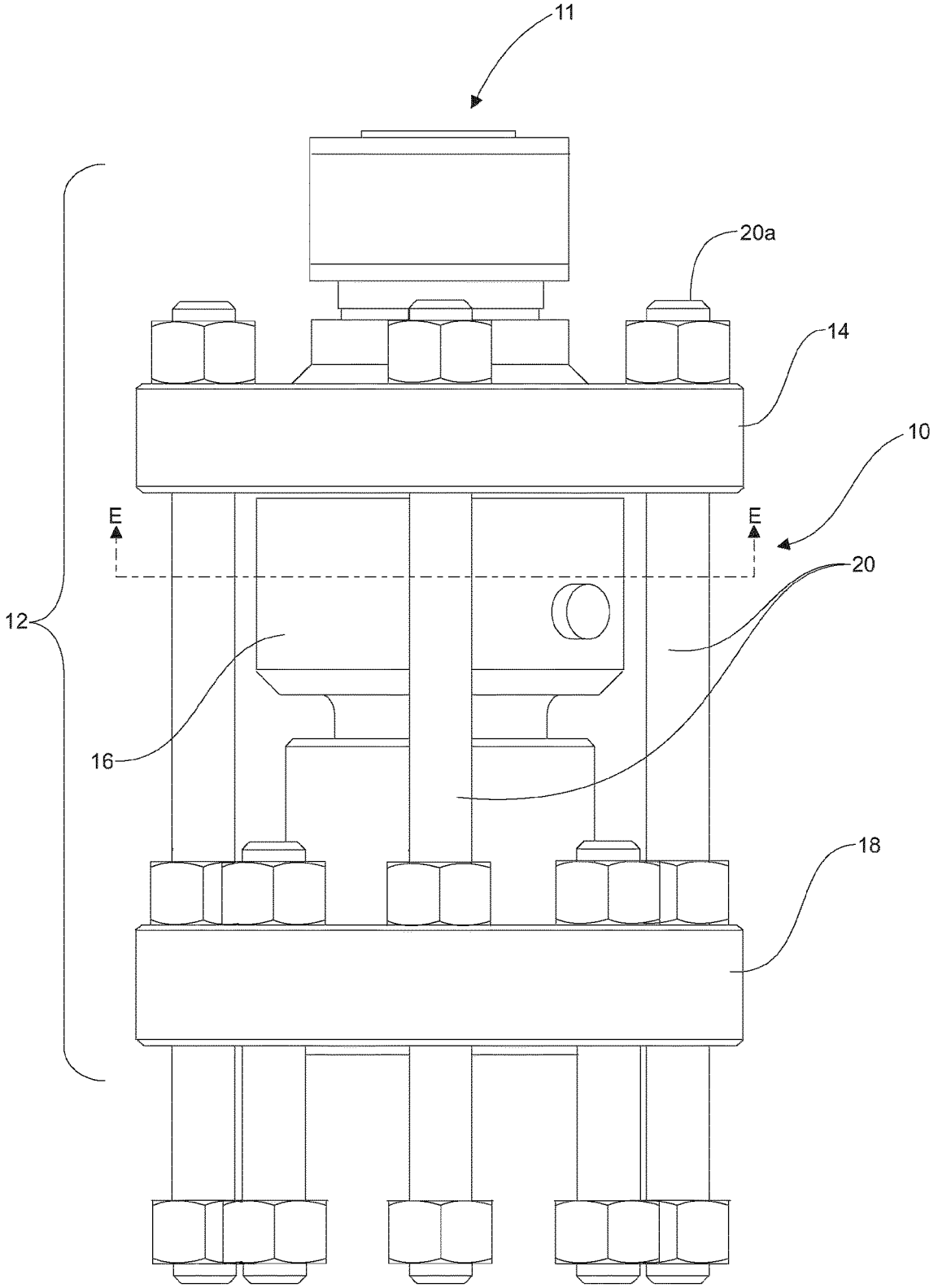
FIG. 5A is a side view of a stuffing box according to embodiments herein.
Figure 5B:
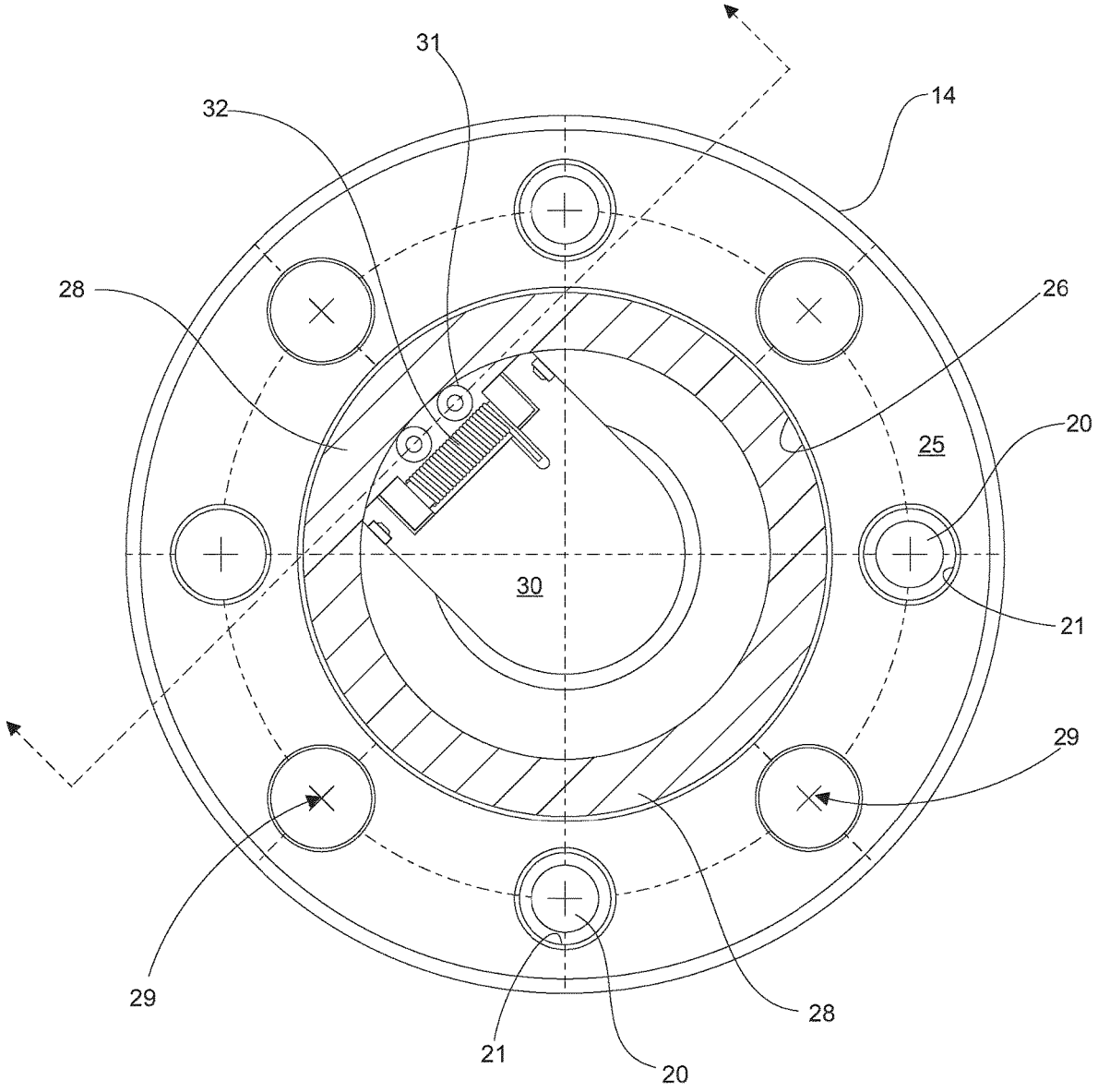
FIG. 5B is a cross section bottom view along line E-E of the stuffing box shown in FIG. 5A.

Having regard to FIGS. 2, 3 and 5, the bottom surface 25 of top housing 14 may be further configured to provide a valve 30, such as a pivotable flapper valve. In a first "open" position, flapper valve 30 may permit the passage of the rod through bore 11 (see FIG. 2C). In a second "closed" position, as may occur during the failure of the rod leaving the wellbore open to the surface, valve 30 may be biased to close and seal the bore 11 of the top housing 14 (see FIGS. 2A, 2B, 3, and 5B). Valve 30 may be biased toward the second (closed) position via spring 32. Valve 30 may be secured to the top housing 14 via any means known in the art. A stopper 35 may be mounted to valve 30, in order to prevent damage to the rod passing through bore 11. It would be understood that stopper 35 may be manufactured from any buffering material (e.g. rubber) for minimizing damage to the metal rod. In one embodiment, valve 30 may be secured to the top housing 14 via at least one screw 31. When in the second (closed) position, valve 30 may be sealingly engaged with top housing 14 via second annular seal 33 (e.g. o-ring) nested within third inner annular groove or seal seat 34 formed in the bottom surface 25 of the top housing 14 (see FIG. 3).

As above, top housing 14 further comprises neck 22. According to embodiments herein, bore 11 of neck 22 may be larger in diameter than rod, such that at least one first seal 40 may be releasably housed within bore 11 of neck 22. The first seal 40 may comprise a plurality of circumferential hydraulic seals known in the art. Preferably, the first seal 40 comprises a plurality of individually stacked packing rings 42 (for e.g. Chevron® seals). It is contemplated that the first seal 40 may be any dynamically-sealing packing elements known in the art whereby the compression of the packing ring results in lateral (outward) deformation of the rings, thereby engaging and sealing with the rod within the bore 11 (see FIG. 2C). It is further contemplated that packing rings 42 may comprise packing rings having a central aperture offset from central axis, enabling the offset rings to be used during rod misalignment until the rod may be realigned.

The at least one first seal 40 may be retained within the bore 11 of the neck 22. For example, the at least one first seal 40 may be retained in position within neck 22 by annular seal seat formed by shoulder 41, such that packing rings 42 may rest on (and be stacked above) shoulder 41. The first seal 40 may further be retained in position by an annular retainer ring 43 (e.g. annular split-ring). Retainer ring 43 may be manufactured from any suitable materials, such as metal (e.g. brass), or any other such materials as may prevent damage to the rod.

In a preferred embodiment, the at least one first seal 40 may effectively be seated at or above the middle housing 16 comprising the flapper valve 30, enabling the first seal 40 to operate as a "back-up" seal (e.g. to at least one second seal positioned at or below valve 30).

The neck 22 of the top housing 14 may further comprise compression means to, in operation, compress the first seal 40, engaging the seal between the packing rings 42 and the rod. In one embodiment, top housing 14 may be adapted to couple with a cap 44. For example, cap 44 may be threaded onto the neck 22 of top housing 14, preventing upward movement of the packing rings 42 and enabling tightening of the threaded engagement to compress both retainer 43 and packing rings 42 in operation. Cap 44 may be easily removed to access retainer 43 and packing rings 42 for repair or replacement.

According to embodiments herein, it is an advantage of the present stuffing box 10 to provide the top housing 14 adapted to house both the first seal and the valve 30, resulting in the box 10 having a shorter profile (e.g. approximately 14" in overall height).

Having further regard to FIG. 2, the middle housing 16 of the body 12 will now be described in more detail. As above, at its upper end middle housing 16 is configured to couple with the bottom surface 25 of top housing 14. At its lower end, middle housing 16 is further configured to couple to bottom housing 18.

In embodiments herein, middle housing 16 may be sized to effectively contain valve 30. For example, middle housing 16 may form fluid cavity 46 for containing valve 30. Middle housing 16 may further provide central channel 48 extending downwardly from the cavity 46, the channel 48 being adapted to couple with the bottom housing 18 in sealing engagement. The external surface of channel 48 may comprise annular seal 55 (e.g. o-ring) nested within annular grove or seal seat 56 formed in the external surface of channel 48 (see FIG. 2B). The internal diameter of channel 48 may be substantially similar to the diameter of the rod.

In embodiments herein, lower housing 18 may be substantially conceptually similar in shape to top housing 16, that is—forming an upper neck portion 52 and a flange portion 54 extending radially outwardly therefrom. According to embodiments herein, the diameter of bore 11 of neck 52 may be larger than rod, such that at least one second seal 50 may be releasably housed within bore 11 of neck 52. Seal 50 may comprise a plurality of circumferential hydraulic seals known in the art. Preferably, second seal 50 comprises a plurality of individually stacked conical packing rings. It is contemplated that second seal 50 may be any dynamically-sealing packing elements known in the art whereby the compression of the packing ring results in lateral (outward) deformation of the rings, thereby engaging and sealing with the rod within the bore 11 (see FIG. 2C). It is further contemplated that seal 50 may comprise packing rings having a central aperture offset from central axis, enabling the offset rings to be used during rod misalignment until the rod may be realigned.

The at least one second seal 50 may be held in position within bore 11 of neck 52 from above by a retainer ring 53 (e.g. annular split-ring). Retainer ring 53 may be manufactured from any suitable materials, such as metal (e.g. brass), or any other such materials as may prevent damage to the rod. The at least one second seal 50 may be retained in position within neck 52 from below by annular seal seat formed by shoulder 51, such that seal 50 may rest on (and be stacked above) shoulder 51.

In a preferred embodiment, the at least one second seal 50 may effectively be seated at or below the middle housing 16 comprising the flapper valve 30, enabling the second seal 50 to operate as a "primary" seal, which, in combination with the at least one first seal 40 provides a dual-pack stuffing box 10 system. It is further advantageous that the at least one second seal 50 prevent flapper valve 30 from being exposed to wellbore fluids and contaminants.

In some embodiments, the modified stuffing box with the flapper valve is configured to withstand wellbore pressures of about 5,000 to about 10,000 psi.

Figure 6A:
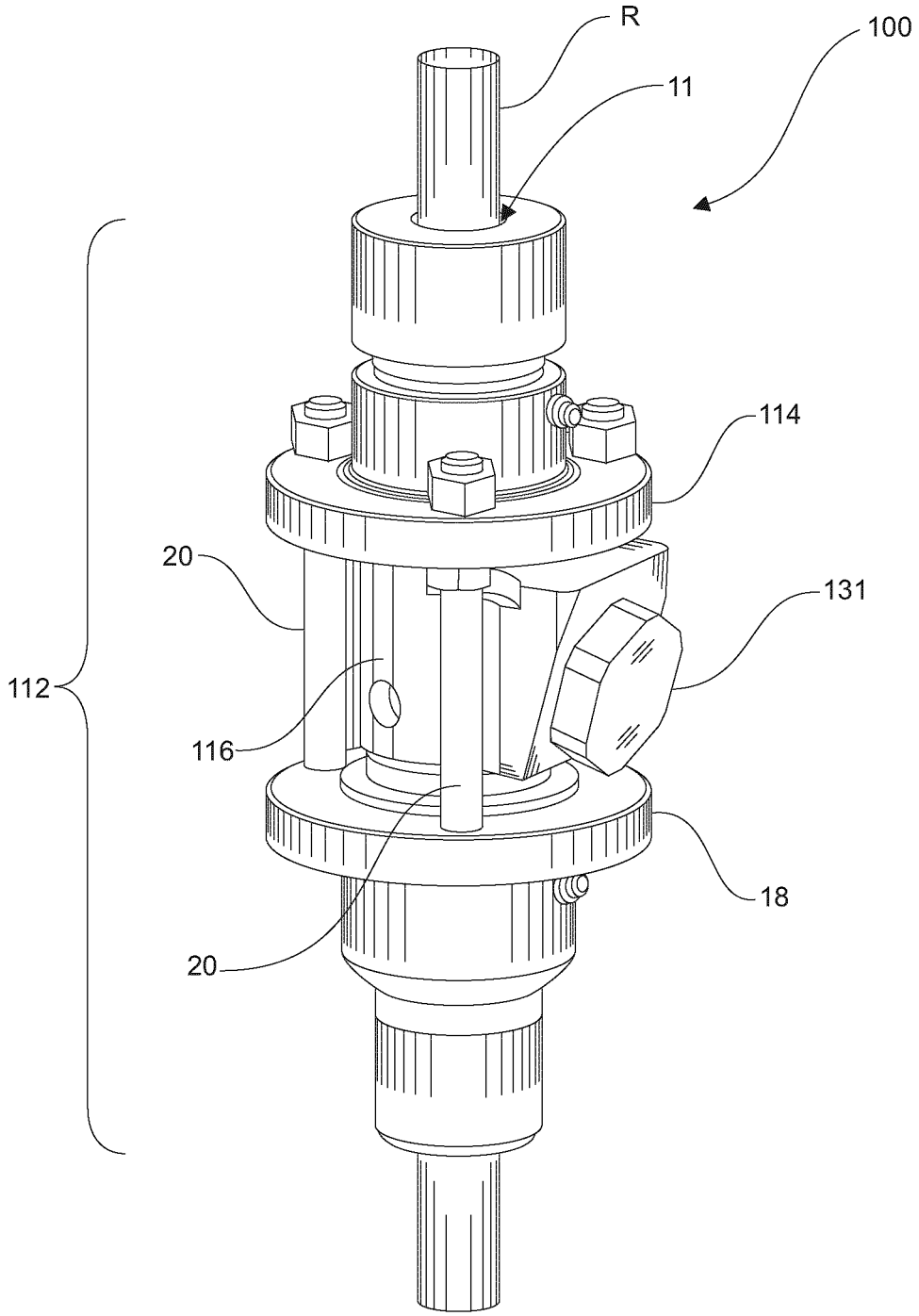
FIG. 6A is a perspective external view of a stuffing box according to other embodiments herein.
Figure 6B:
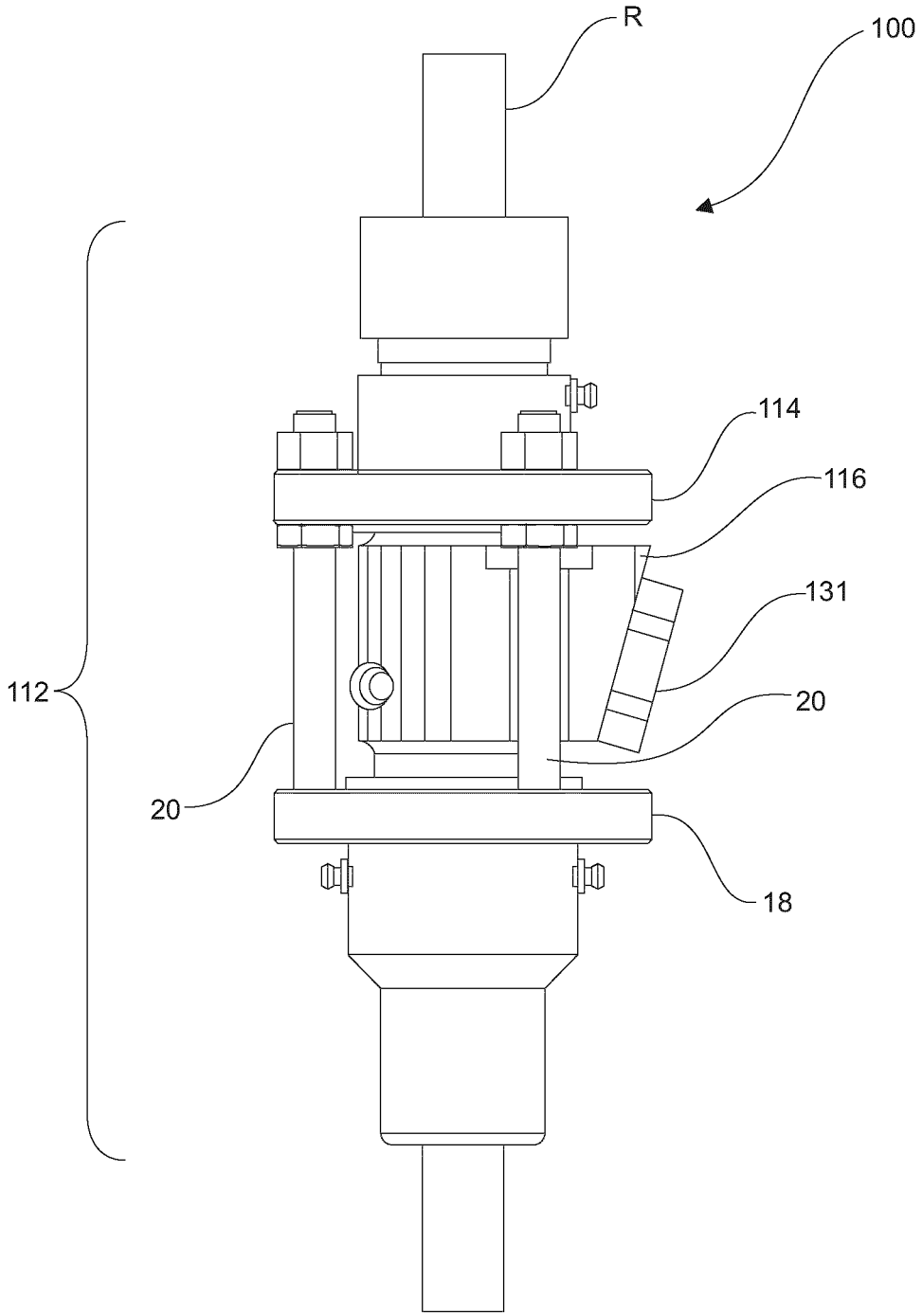
FIG. 6B is a side view of a stuffing box according to other embodiments herein.
Figure 6C:
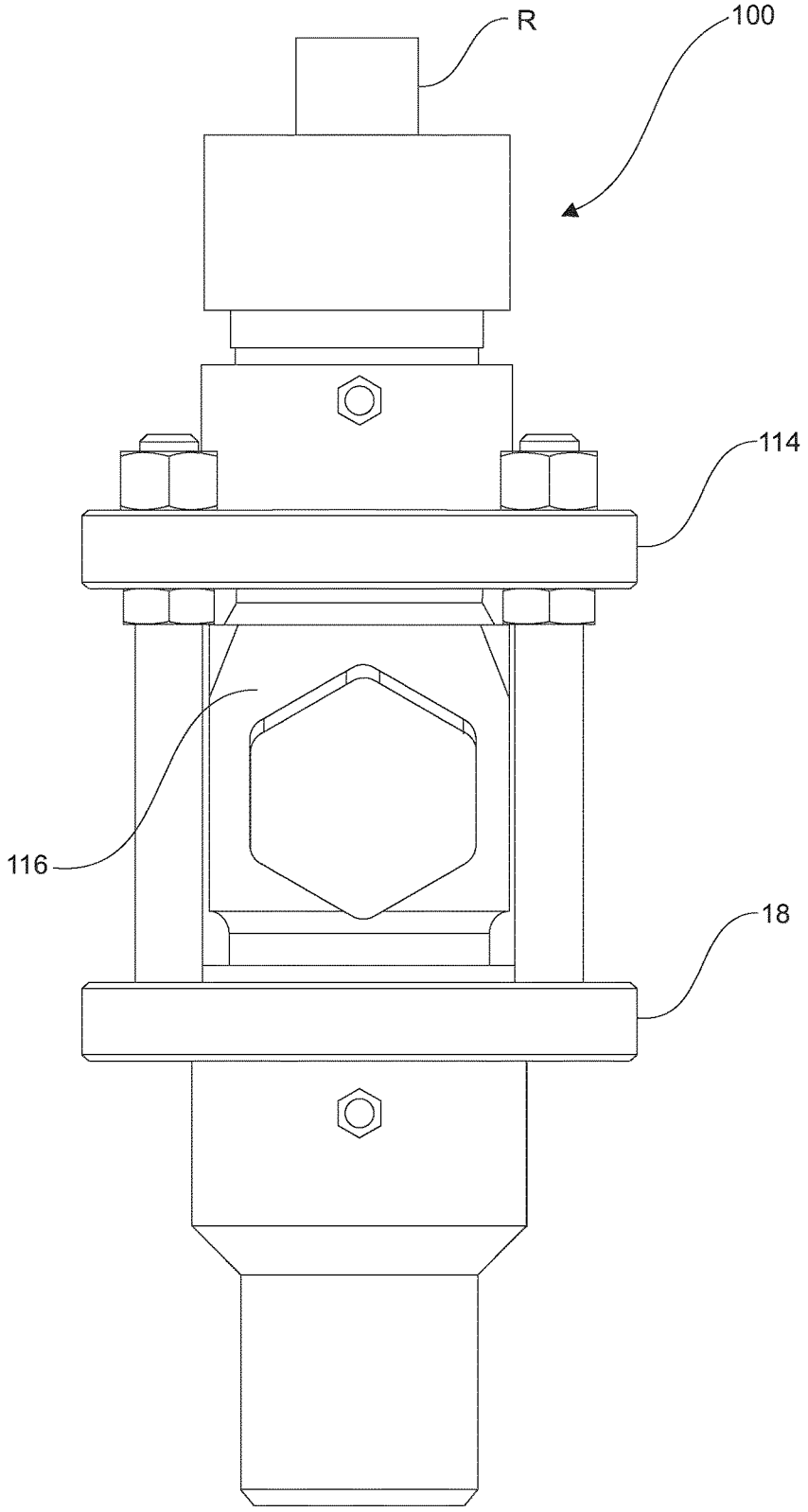
FIG. 6C is an alternate side view of the stuffing box shown in FIG. 6B.
Figure 7A:
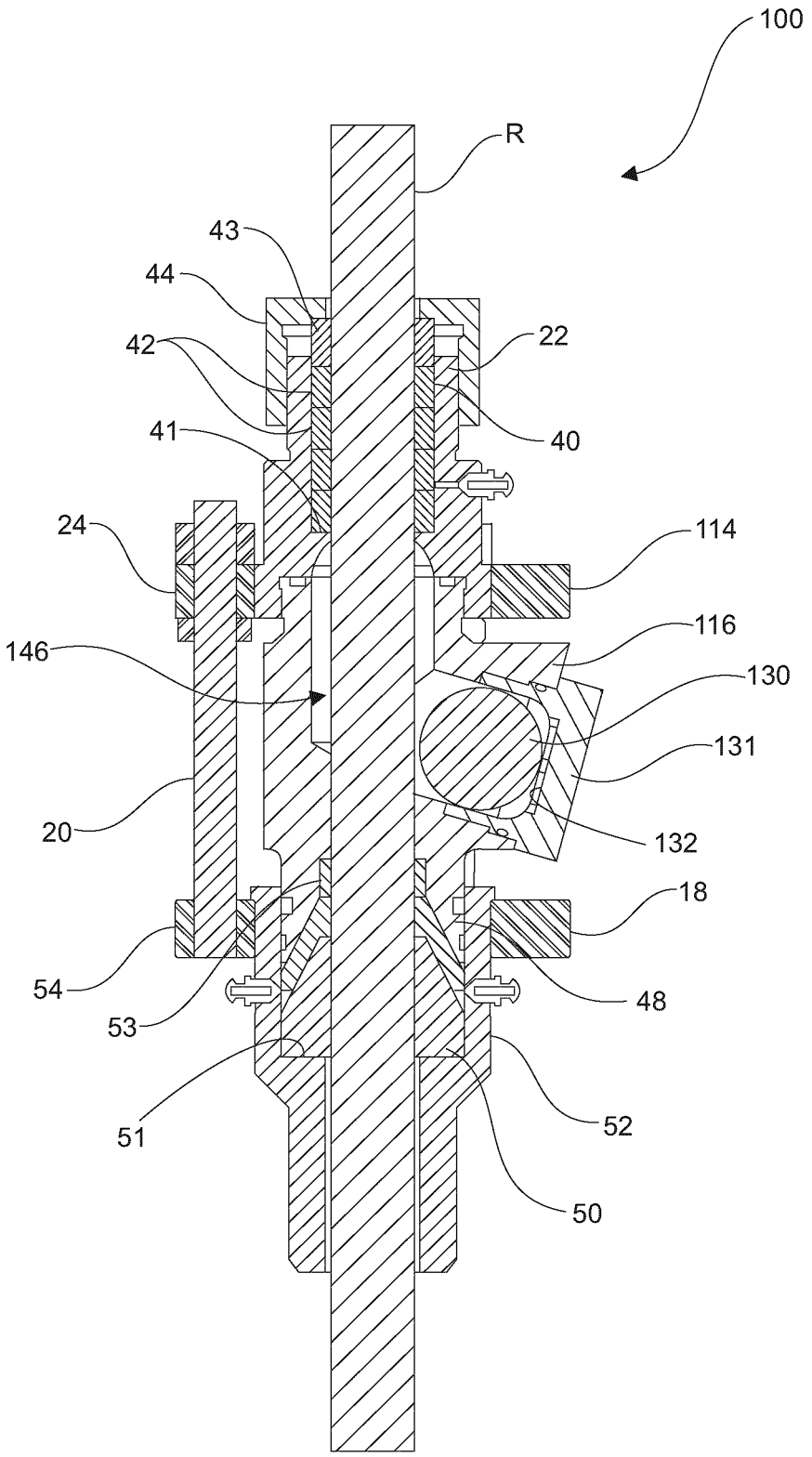
FIG. 7A is a cross section side view along line B-B of the stuffing box shown in FIG. 6C.
Figure 7B:
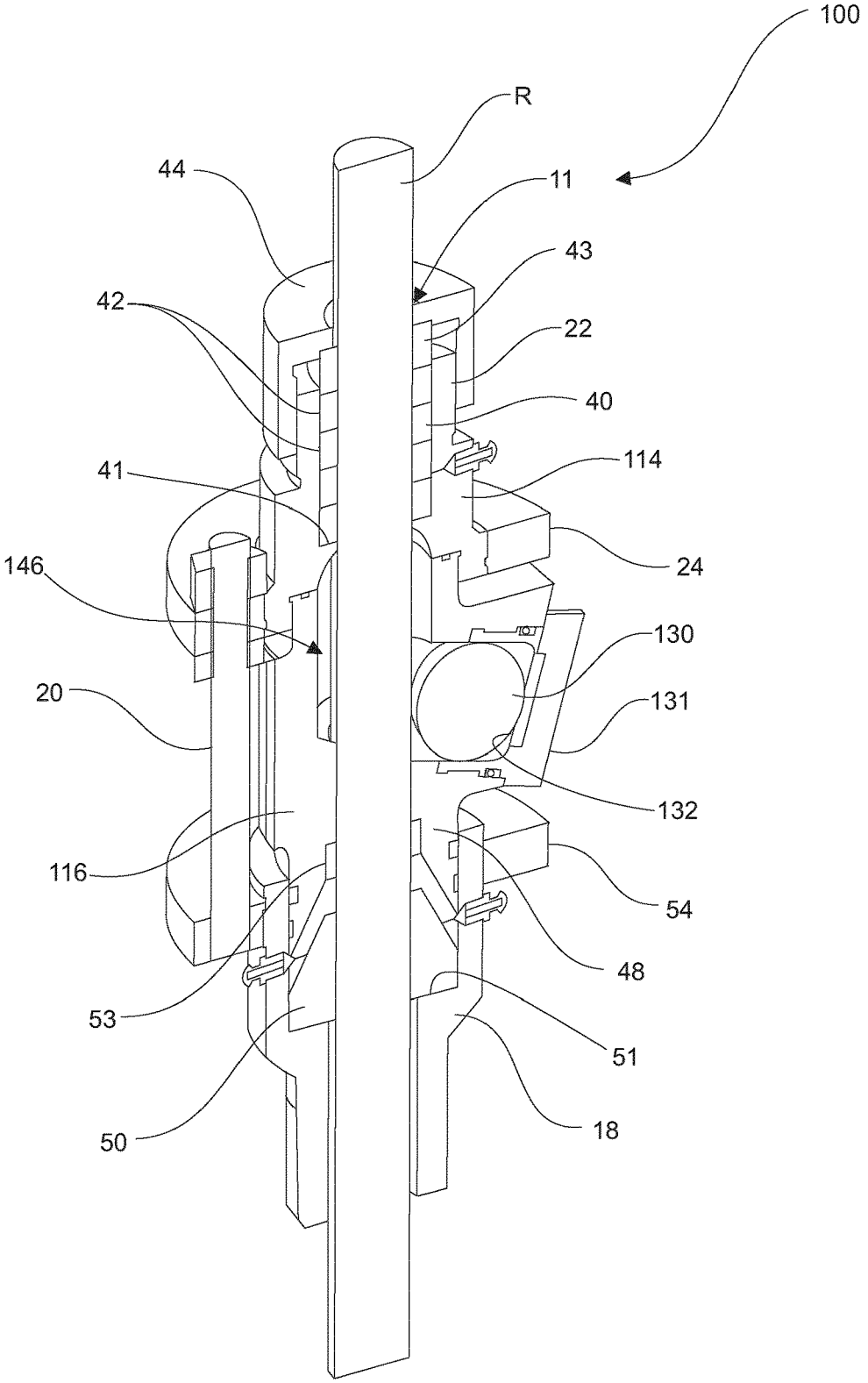
FIG. 7B is a cross section perspective view along line B-B of the stuffing box shown in FIG. 6C.
Figure 8:
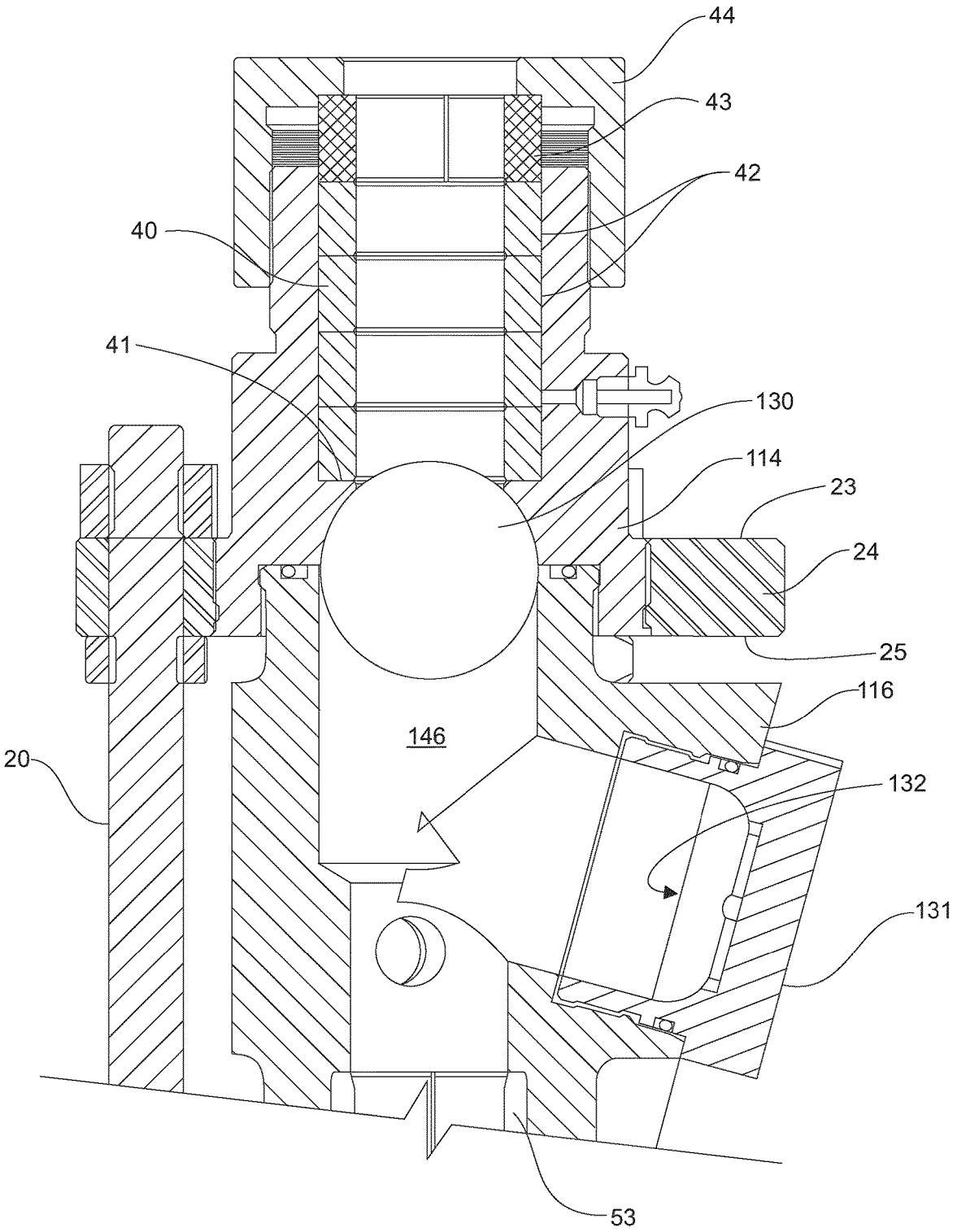
FIG. 8 is a detailed cross section view of a top portion of a stuffing box according to other embodiments herein.

With reference to FIGS. 6 to 8, an alternative stuffing box 100 is shown wherein a ball valve is used instead of the flapper valve. The components of stuffing box 100 are the same or similar to the like-numbered parts described above with respect to stuffing box 10, unless otherwise specified herein.

Stuffing box 100 comprises a body 112 defining a cylindrical passage or bore 11 along a central axis for receiving the rod R. Body 112 may be adapted to be attached to directly or indirectly to a wellhead (not shown). It should be understood that body 112 may be removably attached to the wellhead via any means known in the art such as threaded engagement, a plurality of radially spaced nut/bolt assemblies, etc. Having regard to FIG. 6, the tubular body 112 may comprise coaxially aligned top 114, middle 116 and bottom 18 housing sections.

Top housing 114 and middle housing 116 are similar to and have similar components as top housing 14 and middle housing 16 described above with respect to stuffing box 10, unless otherwise specified herein. Instead of a flapper valve, the top housing 114 and middle housing 116 are configured to provide a ball valve, or a floating ball valve, where the sealing element is substantially spherical in shape. According to embodiments herein, the top and middle housings 114,116 may be coupled to provide a floating ball valve 130 operable between a first "open" position, where the ball permits the passage of the rod through the bore, and a second "closed" position, as may occur during the failure of the rod leaving the wellbore open the surface, where the ball floats to the borehole and plugs it.

Middle housing 116 may be sized to effectively contain the ball 130 capable of sealing engaging the borehole. For example, the inner surface of middle housing 116 may define a cavity 146 for providing passage for the rod and for containing the ball. The cavity 146 may be generally cylindrical in shape and may or may not be fluid-filled. Preferably, the cavity may be shaped in any manner so as to generally prevent the ball from contacting the rod (minimizing wear on the rod), but enabling the ball to immediately float and/or rise to the borehole upon failure of the rod R. For example, middle housing 116 may comprise one or more protrusions 131 extending from its outer surface and the inner surface of each protrusion defines a standby recess 132 providing a seat therein for the ball. The standby recess 132 extends from the cavity 146 and is in fluid communication therewith.

In the open position, as shown for example in FIG. 7, the ball 130 may be positioned in the standby recess 132 extending from and in fluid communication with the cavity, wherein the ball 130 is seated to prevent any direct contact with the rod. Upon failure of the rod, the fluid level in the cavity may rise, thereby urging the ball 130 to become unseated and flow up and out of the standby recess 132 to plug the borehole. In a further embodiment, the standby recess 132 may include a biasing member (not shown) such as a spring in the seat to bias the ball away from the seat towards the borehole in the event of rod failure.

It is an advantage of the present stuffing box that the middle housing 116 and/or cavity 146 may be shaped in any manner without impacting the external adjuster 20 (e.g. the protrusions 131 may extend in between the adjuster, without impacting the adjustment of the adjuster or access to the nesting recesses). Further, it should be understood that replacement of conventional flapper valves with a ball valve, and providing a middle housing having one more protrusions extending from the outer surface, results in the stuffing box 100 having a shorter profile (e.g. approximately 14" in overall height).

It is contemplated that the ball may be manufactured from any suitable material, whereby contact with the rod will not damage the rod. Preferably, for operating temperatures below about 450° F., the ball may be made of plastic, metal, ceramic, polymers, etc., or any combinations and/or hybrids thereof, and may or may not be hollow. In some embodiments, the ball is configured to be buoyant in the wellbore fluids (i.e. the ball has a lower density than the wellbore fluids), which can be achieved for example by the specific material of the ball and/or configuration of the ball (e.g. a hollow ball).

In other embodiments, for example where operating temperatures are high (e.g. above 450° F.), suitable materials for the ball may render the ball leaden in the wellbore fluids; however, upon failure of the rod, the gush of high pressure wellbore fluids into the cavity may be sufficient to push the ball towards the borehole. Where the ball may be leaden in the wellbore fluids, the standby recess 132 may include: (i) a biasing member (for example, a spring) in the seat to bias the ball towards the borehole; and/or (ii) one or more additional flow channels for directing a portion of the gush of wellbore fluids upon rod failure through the standby recess, thereby increasing the fluid pressure within the seat to help push the ball upwardly out of the recess 132. At high temperatures (e.g. above 450° F.) and/or high pressures (above 5000 psi), suitable materials for the ball may include for example solid metals, such as brass, plastic, ceramic, polymers, etc., and any combinations and/or hybrids thereof.

It is also understood that the ball may be any size to effectively seal the borehole, where sealing engagement is increased as a result of pressurized wellbore fluids imposed upward forces upon the ball (e.g. pushing it upwardly into the borehole).

In some embodiments, the modified stuffing box with the ball valve is configured to withstand wellbore pressures of about 1,500 to about 10,000 psi.

Although a few embodiments have been shown and described, it will be appreciated by those skilled in the art that various changes and modifications can be made to these embodiments without changing or departing from their scope, intent or functionality. The terms and expressions used in the preceding specification have been used herein as terms of description and not of limitation, and there is no intention in the use of such terms and expressions of excluding equivalents of the features shown and described or portions thereof, it being recognized that the invention is defined and limited only by the claims that follow.

We claim:

1. A stuffing box for sealing around a rod for wellbore operations, comprising:

a tubular body forming a central bore for receiving the rod, the body having a top, a middle and a bottom housing, the middle housing being positionabie between and sealingly engageable with the top and bottom housings, the top housing having at least one first seal within the bore for sealingly engaging with the rod, the bottom housing having at least one second seal within the bore for sealingly engaging with the rod, and an adjuster for releasably connecting the top housing and the bottom housing, and for adjusting misalignment of the rod within the bore, wherein activation of the adjuster compresses the at least one first and second seals to sealingly engage the rod, and secures the middle housing between the top and bottom housings, and deactivation of the adjusters simultaneously decompresses the at least one first and second seals to disengage the sealing engagement with the rod.

2. The stuffing box of claim 1, wherein the adjuster comprises a plurality of radially spaced connector assemblies.

3. The stuffing box of claim 2, wherein the adjuster comprises at least four radially spaced nut and bolt connector assemblies.

4. The stuffing box of claim 1, wherein the top housing forms a first annular groove for releasably receiving the middle housing in sealing engagement.

5. The stuffing box of claim 1, wherein the top housing is threadably engaged to the middle housing.

6. The stuffing box of claim 1, wherein the top housing further comprises a plurality of radially spaced nesting recesses.

7. The stuffing box of claim 1, wherein the top housing further comprises a valve adapted to pivot between a first position permitting passage of the rod through the bore of the body and a second position sealing the bore of the top housing.

8. The stuffing box of claim 7, wherein the valve is biased towards the second position by a spring.

9. The stuffing box of claim 7, wherein the at least one first seal is positioned at or above the valve.

10. The stuffing box of claim 7, wherein the at least one second seal is positioned at or below the valve.

11. The stuffing box of claim 1, wherein the at least one first seal comprises a plurality of stacked packing rings.

12. The stuffing box of claim 1, wherein the at least one second seal may comprise a plurality of stacked packing rings.

13. The stuffing box of claim 1, wherein the at least one second seal may comprise conical packing rings.

14. The stuffing box of claim 1, wherein the middle housing is configured to house a ball valve operable between a first open position permitting passage of the rod through the bore of the body and a second closed position plugging the borehole and sealing the bore of the top housing.

15. The stuffing box of claim 14, wherein the ball valve comprises a hollow ball.

16. The stuffing box of claim 14, wherein the at least one first seal is positioned at or above the valve.

17. The stuffing box of claim 14, wherein the at least one second seal is positioned at or below the valve.

* * * * *